US011763767B2

(12) United States Patent
Chen et al.

(10) Patent No.: US 11,763,767 B2
(45) Date of Patent: Sep. 19, 2023

(54) DISPLAY METHOD OF DISPLAY PANEL, DISPLAY PANEL AND DISPLAY DEVICE

(71) Applicant: HKC CORPORATION LIMITED, Shenzhen (CN)

(72) Inventors: Wei Chen, Shenzhen (CN); Sihui Yu, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/902,147

(22) Filed: Sep. 2, 2022

(65) Prior Publication Data

US 2022/0415274 A1 Dec. 29, 2022

Related U.S. Application Data

(63) Continuation of application No. PCT/CN2021/136299, filed on Dec. 8, 2021.

(30) Foreign Application Priority Data

Jan. 20, 2021 (CN) ..... 202110078319.6

(51) Int. Cl.
*G09G 3/00* (2006.01)
*G09G 3/36* (2006.01)

(52) U.S. Cl.
CPC ... *G09G 3/3648* (2013.01); *G09G 2310/0264* (2013.01); *G09G 2320/0252* (2013.01);
(Continued)

(58) Field of Classification Search
CPC . G06F 16/27; G06F 3/041; G09G 2320/0252; G09G 2310/08; G09G 3/3648;
(Continued)

(56) References Cited

U.S. PATENT DOCUMENTS 5,309,168 A 5/1994 Itoh et al.
2011/0242412 A1* 10/2011 Lee ..... G06F 3/1446 348/E5.009

(Continued)

FOREIGN PATENT DOCUMENTS

CN 1632661 A 6/2005
CN 103309097 A 9/2013

(Continued)

OTHER PUBLICATIONS

First Office Action issued in counterpart Chinese Patent Application No. 202110078319.6, dated Jun. 30, 2021.

(Continued)

*Primary Examiner* — Michael A Faragalla
(74) *Attorney, Agent, or Firm* — Westbridge IP LLC

(57) ABSTRACT

Disclosed is a display method of a display panel. The display panel includes two display screens arranged opposite to each other, and the display method of the display panel includes: acquiring a liquid crystal response duration of each display screen upon receiving image information to be displayed; taking a display screen having a shorter liquid crystal response duration as a first display screen, and taking a display screen having a longer liquid crystal response duration as a second display screen; and driving the second display screen to display, and delaying to drive the first display screen to display. A display device and a display panel are also disclosed. The display panel of the present application has a good display effect.

9 Claims, 3 Drawing Sheets

(52) U.S. Cl.
CPC ..... *G09G 2360/04* (2013.01); *G09G 2360/18* (2013.01); *G09G 2370/08* (2013.01)

(58) Field of Classification Search
CPC ..... G09G 2310/0264; G09G 2360/04; G09G 2360/18; G09G 2370/08
See application file for complete search history.

(56) References Cited

U.S. PATENT DOCUMENTS

| | | | | |
|---|---|---|---|---|
| 2013/0330011 | A1* | 12/2013 | Sato | H04N 19/88 382/233 |
| 2014/0101535 | A1* | 4/2014 | Kim | G06F 3/04886 715/761 |
| 2016/0299369 | A1* | 10/2016 | He | G02F 1/136286 |
| 2020/0174141 | A1* | 6/2020 | Lubinsky | G01T 1/2018 |

FOREIGN PATENT DOCUMENTS

| | | | |
|---|---|---|---|
| CN | 203299486 | U | 11/2013 |
| CN | 203299498 | U | 11/2013 |
| CN | 103926720 | A | 7/2014 |
| CN | 106571124 | A | 4/2017 |
| CN | 108227286 | A | 6/2018 |
| CN | 111999948 | A | 11/2020 |
| CN | 112687244 | A | 4/2021 |

OTHER PUBLICATIONS

International Search Report and Written Opinion issued in corresponding PCT Application No. PCT/CN2021/136299, dated Mar. 1, 2022.

* cited by examiner

DISPLAY METHOD OF DISPLAY PANEL, DISPLAY PANEL AND DISPLAY DEVICE

CROSS-REFERENCE TO RELATED APPLICATIONS

This application is a continuation application of International Application No. PCT/CN2021/136299, filed on Dec. 8, 2021, which claims priority to Chinese Patent Application No. 202110078319.6, filed on Jan. 20, 2021. The disclosures of the aforementioned applications are incorporated in this application by reference in their entirety.

TECHNICAL FIELD

This application relates to the technical field of display panels, in particular to a display method of a display panel, a display panel and a display device.

BACKGROUND

Dual-screen displaying is a display technology in which two liquid crystal displays (LCDs) are overlapped and combined. That is, the display panel includes an upper display screen and a lower display screen. The upper display screen is the same as the traditional single screen, and the lower display screen provides only a dimming function, so that the backlight can be accurately controlled according to the display data, and the black pictures of the LCD display panel become blacker due to less light leakage. Therefore the contrast is greatly improved, and the picture quality of the LCD display panel can be comparable to that of the organic light-emitting diode (OLED) display technology.

In the exemplary technology, the display effect of the display panel containing double display screens is poor.

SUMMARY

The main object of the present application is to provide a display method of a display panel, a display panel and a display device, which aim to solve the problem of poor display effect of a display panel containing double display screens.

In order to achieve the above object, the display method of the display panel is provided by the present application, the display panel includes two display screens opposite to each other, and the display method of the display panel includes:

acquiring a liquid crystal response duration of each display screen upon receiving image information to be displayed;

taking a display screen having a shorter liquid crystal response duration as a first display screen, and taking a display screen having a longer liquid crystal response duration as a second display screen; and driving the second display screen to display, and delaying to drive the first display screen to display.

In an embodiment, after the taking the display screen having the shorter liquid crystal response duration as the first display screen, and taking the display screen having the longer liquid crystal response duration as the second display screen, the method further includes:

determining a first difference between the liquid crystal response duration of the first display screen and the liquid crystal response duration of the second display screen; and determining a duration of delaying to drive of the first display screen according to the first difference.

In an embodiment, after the determining the duration of delaying to drive of the first display screen according to the first difference, the method further includes:

determining a target illumination intensity of a backlight according to the duration of delaying to drive; and controlling the backlight to emit light to each display screen according to the target illumination intensity, and executing the driving the second display screen to display.

In an embodiment, the determining the target illumination intensity of the backlight according to the duration of delaying to drive includes:

determining a preset illumination intensity as the target illumination intensity of the backlight, where the duration of delaying to drive is equal to the first difference.

In an embodiment, each display screen is provided with a data buffer, and each data buffer is configured for caching the image information to be displayed; and the driving the second display screen to display, and delaying to drive the first display screen to display includes:

delaying input of the information by controlling a read/write clock of a data buffer corresponding to the first display screen, to drive the first display screen to delay display relative to the second display screen.

In order to achieve the above object, the present application further provides a display panel, the display panel includes two display screens arranged opposite to each other and a controller, each of the display screens is connected to the controller, and the controller performs the following operations upon receiving image information to be displayed:

acquiring a liquid crystal response duration of each display screen;

taking a display screen having a shorter liquid crystal response duration as a first display screen, and taking a display screen having a longer liquid crystal response duration as a second display screen; and driving the second display screen to display, and delaying to drive the first display screen to display.

In an embodiment, a resolution of the second display screen is higher than a resolution of the first display screen, and a thickness of the first display screen after a thin film transistor substrate and a color filter substrate of the first display screen are assembled together is less than a thickness of the second display screen after a thin film transistor substrate and a color filter substrate of the second display screen are assembled together.

In an embodiment, a thin film transistor substrate of the second display screen is provided with a color filter film, and a thin film transistor substrate of the first display screen is provided without a color filter film.

In an embodiment, the display panel includes a driving board provided with the controller and a data buffer corresponding to each display screen, and upon receiving the image information to be displayed, the driving board is configured to process the image information, store processed display data into the data buffer of each display screen, and control a read/write clock of each data buffer according to the liquid crystal response duration of each display screen, to drive the display screen having the shorter liquid crystal response duration to delay to display.

In order to achieve the above object, the present application further provides a display device including the display panel as described above.

According to the display method of the display panel, the display panel and the display device provided by the present application, the method includes that, upon receiving the image information to be displayed, the driving device of the display panel determines the response duration of each display screen, takes the display screen with the shorter liquid crystal response duration as the first display screen and takes the display screen with the longer liquid crystal response duration as the second display screen, thereby driving the second display screen to display and delay driving the first display screen to display. Therefore, a difference between rotation angles of the liquid crystals of the first display screen and rotation angles of the liquid crystals of the second crystal screen is reduced, the transmittance amount of light of the display panel is increased, and the display effect of the display panel containing double display screens is good.

The realization of the objectives, functional features and advantages of the present application will be further explained with reference to the accompanying drawings in combination with the embodiment.

DETAILED DESCRIPTION OF THE EMBODIMENTS

It should be understood that the specific embodiments described herein are only used to explain the present application, and are not intended to limit the present application.

The main solution of the embodiments of the present application is as follows: upon receiving image information to be displayed, acquiring a liquid crystal response duration of each of display screens; taking a display screen having a shorter liquid crystal response duration as a first display screen, and taking a display screen having a longer liquid crystal response duration as a second display screen; and driving the second display screen to display, and delaying to drive the first display screen to display.

Due to that the first display screen with a shorter liquid crystal response duration is delayed to display, the difference between rotation angles of liquid crystals of the first display screen and rotation angles of liquid crystals of the second crystal screen is small, therefore the transmittance amount of light of the display panel is increased, and the display effect of the display panel containing double display screens is good.

Figure 1:
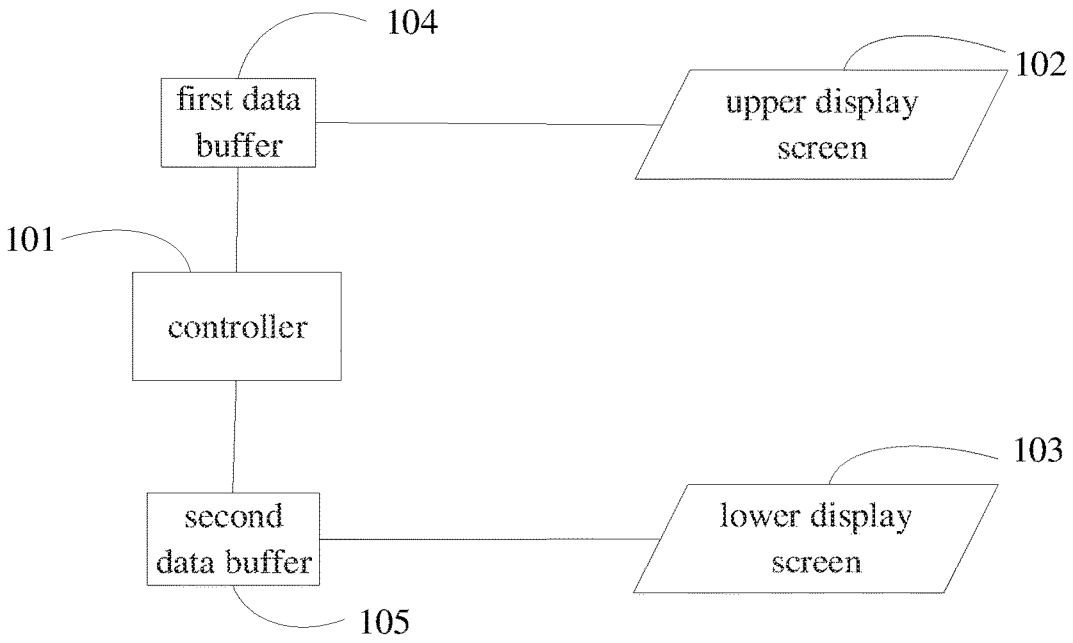
FIG. 1 is a schematic diagram of a hardware structure of a display panel according to an embodiment of the present application.

As an implementation, the display panel may be as that shown in FIG. 1.

This embodiment of the present application relates to a display panel. The display panel includes a controller 101, an upper display screen 102, a lower display screen 103, a first data buffer 104 and a second data buffer 105. The controller 101 is connected to the upper display screen 102 and the lower display screen 103. The first data buffer 104 is connected to the upper display screen 102 and the controller 101, and the second data buffer 105 is connected to the lower display screen 103 and the controller 101. The controller 101 may be disposed on a field programmable gate array (FPGA) driving board, and the first data buffer 104 and the second data buffer 105 may be frame buffers. The two data buffers are configured to buffer image information to be displayed. Upon receiving the image information to be displayed, the controller 101 performs the following operations:

acquiring a liquid crystal response duration of each of the display screens;

taking a display screen having a shorter liquid crystal response duration as a first display screen, and taking a display screen having a longer liquid crystal response duration s a second display screen; and driving the second display screen to display, and delaying to drive the first display screen to display.

In an embodiment, the controller 101 further performs the following operations:

determining a difference between the liquid crystal response duration of the first display screen and the liquid crystal response duration of the second display screen as a first difference;

determining a duration of delaying to drive of the first display screen according to the first difference.

In an embodiment, the controller 101 further performs the following operations:

the duration of delaying to drive being less than or equal to the first difference and greater than zero.

In an embodiment, the controller 101 further performs the following operations:

determining a target illumination intensity of a backlight according to the duration of delaying to drive;

controlling the backlight to emit light to each display screen according to the target illumination intensity, and executing the operation of driving the second display screen to display.

In an embodiment, the controller 101 further performs the following operations:

determining a preset illumination intensity as the target illumination intensity of the backlight, where the duration of delaying to drive is equal to the first difference.

In an embodiment, the controller 101 further performs the following operations:

increasing the preset illumination illumination intensity according to a second difference between the first difference and the duration of delaying to drive, wherein the duration of delaying to drive is less than the first difference;

determining the increased preset illumination intensity as the target illuminati intensity of the backlight.

In an embodiment, the controller 101 further performs the following operations:

delaying input of the image information by controlling a read/write clock of a data buffer corresponding to the first display screen, to drive the first display screen to delay display relative to the second display screen.

According to the above solution, upon receiving image information to be displayed is received, a driving device of the display panel determines a response duration of each display screen, takes a display screen with a shorter liquid crystal response duration as a first display screen and takes a display screen with a longer liquid crystal response duration as a second display screen, so as to drive the second display screen to display and delay to drive the first display screen to display. Therefore, a difference between rotation angles of the liquid crystals of the first display screen and rotation angles of the liquid crystals of the second crystal screen is reduced, the transmittance amount of light of the display panel s increased, and the display effect of the display panel containing double display screens is good.

Based on the foregoing hardware structure, embodiments of a display method of the display panel of the present application are presented.

Figure 2:
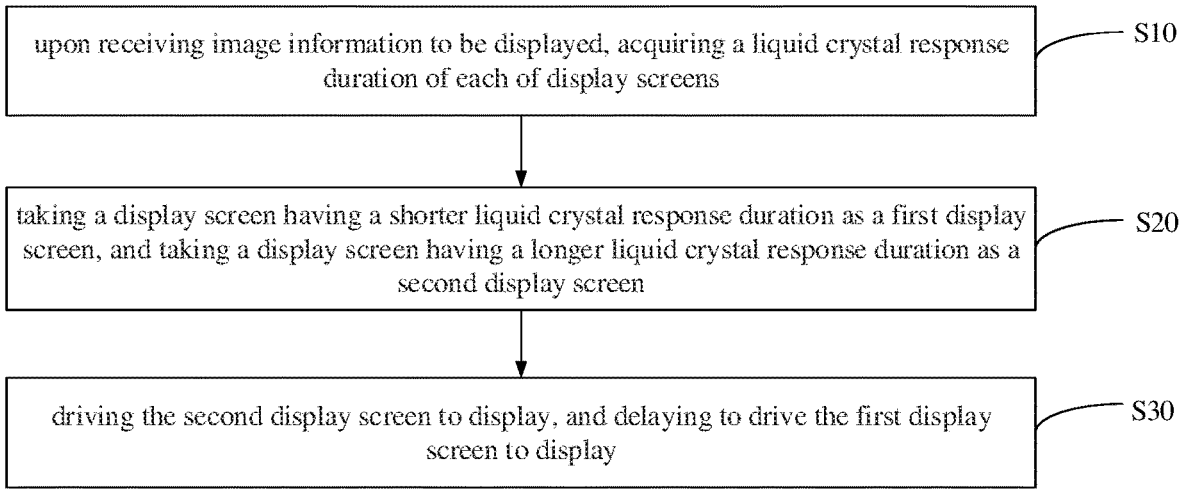
FIG. 2 is a schematic flowchart of a display method of a display panel according to an embodiment of the present application.

Referring to FIG. 2, FIG. 2 is an embodiment of the display method of the display panel according to an embodiment of the present application. The display method of the display panel includes the following operations:

operation S10, upon receiving image information to be displayed, acquiring a liquid crystal response duration of each of display screens.

In this embodiment, the display panel includes an upper display screen and a lower display screen, and light emitted by the backlight passes through the lower display screen and enters the upper display screen. It can be understood that the lower display screen acts as providing a dimming function, and the display panel can make the black pictures become blacker due to less light leakage, thereby improving the picture quality of the display panel.

Since the lower display screen acts only as providing a dimming function, a resolution of the lower display screen can be smaller than a resolution of the upper display screen. That is, the resolution of the upper display screen and the resolution of the lower display screen are different, and one pixel of the lower display screen corresponds to a plurality of pixels of the upper display screen. For example, one pixel of the lower display screen corresponds to four pixels of the upper display screen. Since the resolution of the upper display screen is greater than the resolution of the lower display screen, the processes of preparing the upper display screen and the lower display screen are different, thus a thickness of a thin film transistor (TFT) substrate and a color filter (CF) substrate of the upper display screen after being assembled together is different from a thickness of a TFT substrate and a CF substrate of the lower display screen after being assembled together. For the thicknesses are, different, the response times of the liquid crystals of the two display screens are different, and the liquid crystals of the two display screens cannot rotate to the same positions at the same time, therefore the display brightness of the whole display panel is reduced, and the display effect of the display panel becomes poor. The response duration of the liquid crystals refers to the duration from a time point of a voltage being applied to the liquid crystal molecules to a time point of the liquid crystal molecules start to rotate.

The resolution of the upper display screen is higher than the resolution of the lower display screen. Therefore, compared with the TFT substrate of the lower display screen, there are more thin film transistors on the TFT substrate of the upper display screen, and the TFT substrate of the upper display screen has a heavier load, Therefore, after the TFT substrate and the CF substrate are assembled together, a thickness of the upper display screen is greater than a thickness of the lower display screen, that is, the liquid crystal response duration of the upper display screen is longer than the liquid crystal response duration of the lower display screen.

In addition, since the lower display screen acts as providing a dimming function, a color filter film is not needed for the lower display screen, however a color filter film is needed to be provided on the TFT substrate of the upper display screen. For this, after the upper display screen and the lower display screen of the display panel are prepared, the liquid crystal response durations of the upper display screen and the lower display screen are tested and stored in the driving device of the display panel. Upon receiving the image information to be displayed, the driving device of the display panel acquires the liquid crystal response duration of each display screen.

Operation S20, taking a display screen having a shorter liquid crystal response duration as a first display screen, and taking a display screen having a longer liquid crystal response duration as a second display screen.

Operation S30, driving the second display screen to display, and delaying to drive the first display screen to display.

Figure 3:
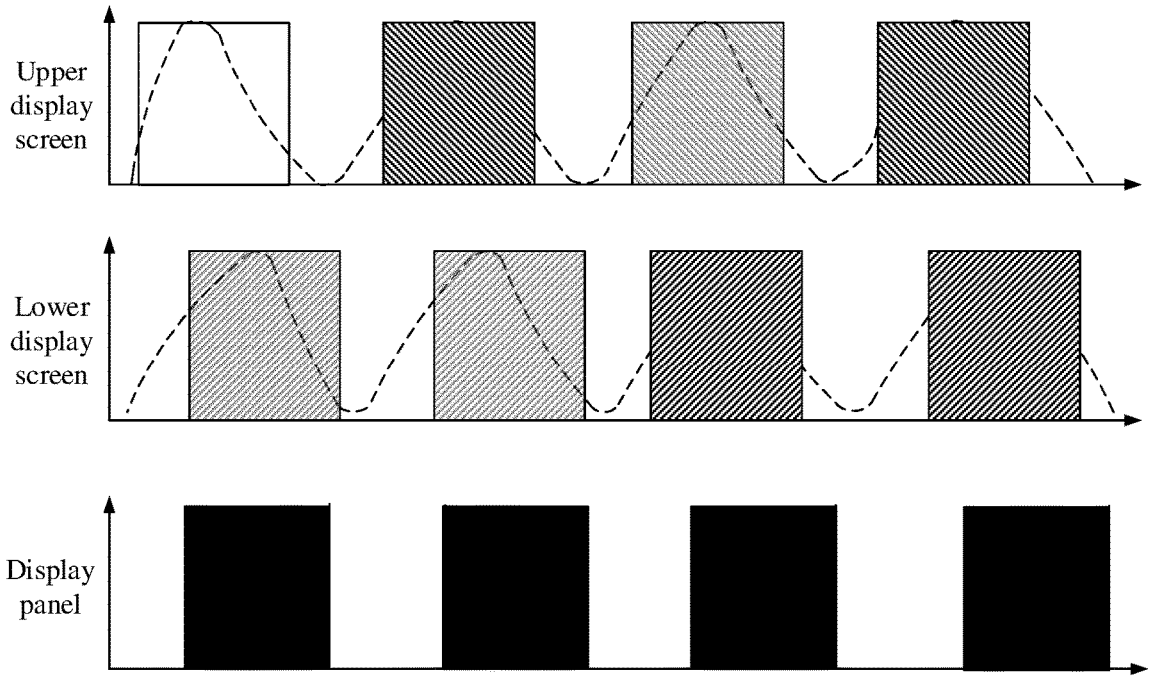
FIG. 3 is a diagram showing picture outputting of the display panel after a target display screen is delayed according to the present application.

The driving device of the display panel can perform delay display on the display screen with the shorter liquid crystal response duration, so that a time difference between a rotation time point of the liquid crystals of this display screen and a rotation time point of the liquid crystals of the display screen with the longer liquid crystal response duration is reduced, that is, a difference between rotation angles of the liquid crystals of the two display screens is reduced. For this purpose, after the liquid crystal response durations of the two display screens are determined, the display screen having the shorter liquid crystal response duration is taken as a first display screen, and the display screen with the longer liquid crystal response duration taken as a second display screen. Finally the second display screen is driven to display immediately, and the first display screen is driven to delay to display. The driving device of the display panel may implement the delay display of the first display screen by delaying input time point of a driving signal of the first display screen, and the driving signal may be a row scanning signal. In an embodiment, referring to FIG. 3, FIG. 3 is diagram showing picture outputting of the display panel after the first display screen is delayed by the display panel. In FIG. 3, the liquid crystal response duration of the upper display screen is longer than the liquid crystal response duration of the lower display screen. Therefore, the driving signal of the lower display screen is delayed to obtain an actual display screen of the display panel. In FIG. 3, the dashed line represents the driving signal.

It should be noted that before driving the first display screen and the second display screen, the driving device of the display panel firstly caches the image information to be displayed to the data buffers corresponding to the two display screens, and then obtains the image information from the data buffers to drive the display screens to display. The driving device of the display panel controls the read/write clock of the data buffers according to the liquid crystal response duration of each display screen, thereby to drive the display screen with the shorter liquid crystal response duration to delay display. In addition, when to cache the image information in the data buffers, the image information needs to be processed, and then the processed image information is cached in the data buffers. The processing of the image information may be such as format processing, data length compression, etc.

In the technical solution provided in this embodiment, upon receiving the image information to be displayed, the driving device of the display panel determines the response duration of each display screen, takes the display screen with the shorter liquid crystal response duration as the first display screen and takes the display screen with the longer liquid crystal response duration as the second display screen, thereby driving the second display screen to display and delay driving the first display screen to display. Therefore, a difference between rotation angles of the liquid crystals of the first display screen and rotation angles of the liquid crystals of the second crystal screen is reduced, the transmittance amount of light of the display panel is increased, and the display effect of the display panel containing double display screens is good.

Figure 4:
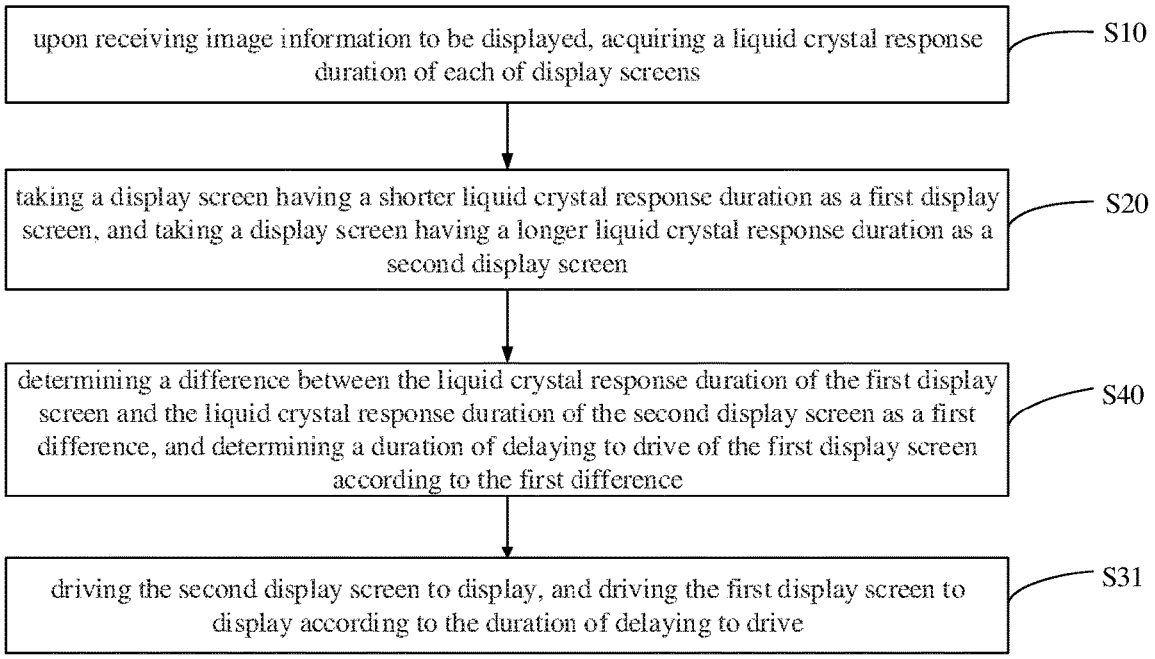
FIG. 4 is a schematic flowchart of a method of controlling a read/write operation of the display panel according to another embodiment of the present application.

Referring to FIG. 4, FIG. 4 is another embodiment of the display method of the display panel according to the present application. After operation S20, the method further includes:

operation S40, determining a difference between the liquid crystal response duration of the first display screen and the liquid crystal response duration of the second display screen as a first difference, and determining a duration of delaying to drive of the first display screen according to the first difference; and operation S31 driving the second display screen to display, and driving the first display screen to display according to the duration of delaying to drive.

In this embodiment, the display panel calculates a first difference between response durations of the two display screens, and the first difference represents a time difference of rotations of the liquid crystals of the two display screens.

For this, the duration of delaying to drive of the driving signal of the first display screen can be determined according to the first difference. In this embodiment, a absolute value of the difference between the duration of delaying to drive and the first difference than the first difference, that is, the time difference between the rotations of the liquid crystals of the two display screens becomes smaller. The difference between the duration of delaying to drive and the first difference may be a positive value or a negative value. It can be understood that when the duration of delaying to drive is greater than the first difference, the rotation time point of the liquid crystals of the first display screen is later than the rotation time points of the liquid crystals of the second display screen. When the duration of delaying to drive is less than the first difference, the rotation time point of the liquid crystals of the first display screen is earlier than the rotation time point of the liquid crystals of the second display screen.

After the duration of delaying to drive is determined, the display time point of the first display screen can be determined according to the duration of delaying to drive and s current time point, and the driving signal is input to the first display screen when the display time point is reached.

In the technical solution provided in this embodiment, the display panel determines the duration of delaying to drive of the driving signal of the first display screen according to the first difference between the response durations of the liquid crystals of the two display screen, and drive the first display screen to display according to the duration of delaying to drive, thereby to reduce the difference between the rotation angles of the liquid crystals of the two display screen, and increase the display brightness of the display panel.

In an embodiment, the duration of delaying to drive may be greater than the first difference, and a difference between the duration of delaying to drive and the first difference is less than the first difference. When to display the image information to be displayed by the display panel, the buffered image information is read generally when the liquid crystal in the display screen is rotated for display. Since the duration of delaying to drive is too long, the time for displaying the image on the display panel is long. For this, in this embodiment, the duration of delaying to drive is less than or equal to the first difference and greater than zero, so as to minimize the time of delay displaying the picture on the display panel. It should be noted that when the duration of delaying to drive is equal to the first difference, the liquid crystals of the two display screens can synchronously rotate to the same positions, and at this time, the display brightness of the display panel is the best. In this embodiment, the delay displaying of the picture on the display panel and the loss of the display brightness of the display panel should be considered, and the duration of delaying to drive can be determined according to actual requirements, so that the time of delay displaying the picture is short and the display brightness loss is small.

Figure 5:
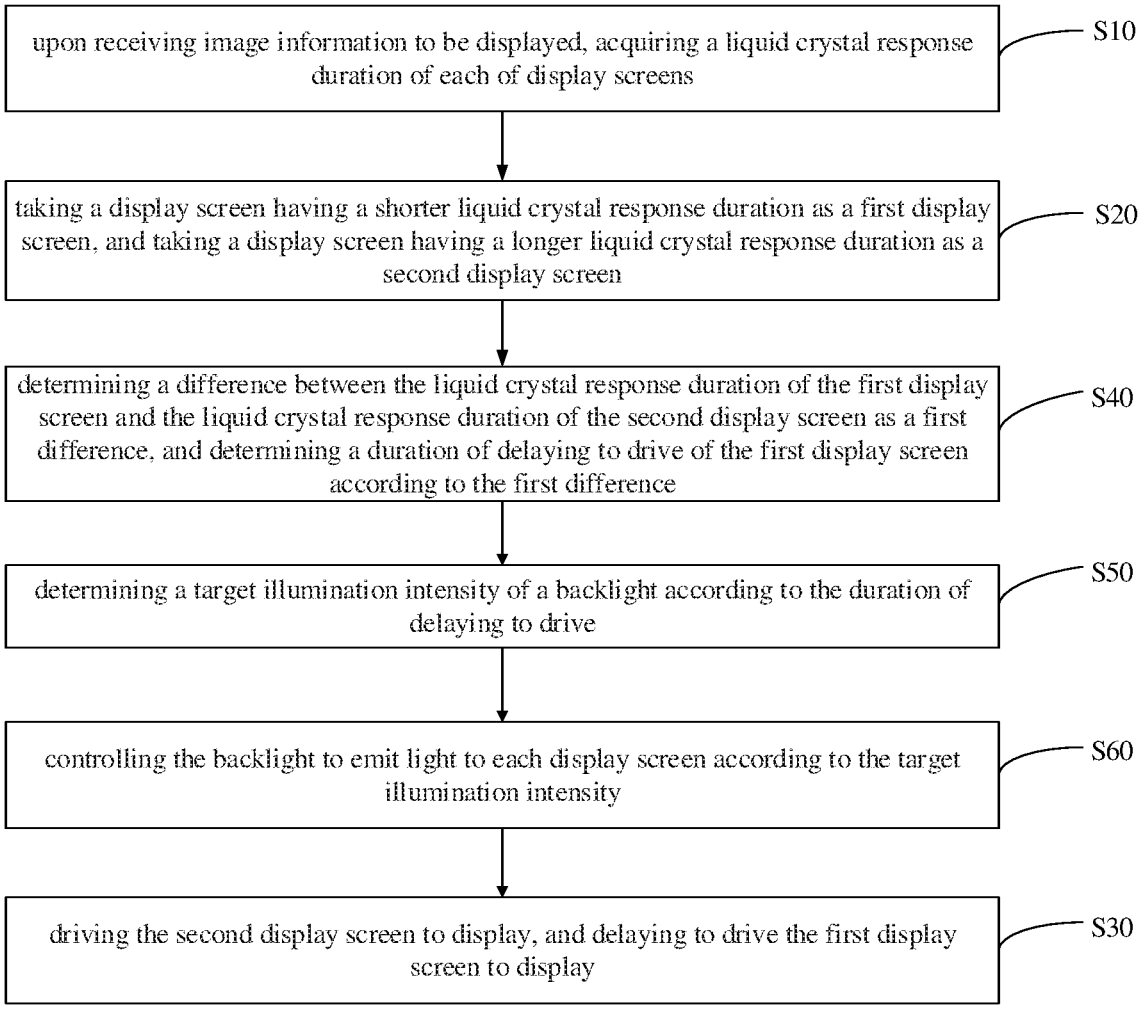
FIG. 5 is a flowchart of a method of controlling a read/write operation of the display panel according to still another embodiment of the present application.

Referring to FIG. 5, FIG. 5 is still another embodiment of the display method of the display panel according to the present application. After operation S40, the method further includes:

operation S50, determining a target illumination intensity of a backlight according to the duration of delaying to drive; and operation S60, controlling the backlight to emit light to each display screen according to the target illumination intensity.

In this embodiment, since the rotation of the liquid crystals of the two display screens is not synchronized, the display brightness of the display panel is lost. The duration of delaying to drive determines an amount of the lost display brightness. If the duration of delaying to drive is equal to the first difference, it indicates that the display brightness loss of the display panel is less. If the second difference between the duration of delaying to drive and the first difference, which is an absolute value, is larger, the difference between the rotation angles of the liquid crystals of the two display screens is greater, and the display brightness loss of the display panel is greater. For this, the display panel determines the target illumination intensity of the backlight according to the duration of delaying to drive. The illumination intensities of the backlight which can eliminate the display brightness loss can be tested corresponding to different durations of delaying to drive. Therefore, a mapping relationship between the durations of delaying to drive and the illumination intensities can be established to determine the target illumination intensity of the backlight according to the mapping relationship and the duration of delaying to drive.

After the target illumination intensity is determined, the backlight can be controlled to emit light at the target illumination intensity.

In the technical solution provided in this embodiment, the driving device of the display panel determines the target illumination intensity of the backlight according to the duration of delaying to drive, and under the situation that the display screen delay of the display panel is ensured to be relatively short, the display brightness loss when the duration of delaying to drive is not equal to the first difference is made up.

In an embodiment, when the duration delaying to drive is equal to the first difference, the target illumination intensity may be a preset illumination intensity. When the duration of delaying to drive is not equal to the first difference, the second difference between the first difference and the duration of delaying to drive, which is an absolute value, is calculated, thereby the preset illumination intensity is increased according to the second difference to obtain the target illumination intensity, that is, the target illumination intensity is greater than the preset illumination intensity. In this embodiment, the duration of delaying to drive for displaying the first display screen can be set, so as to test the mapping relationship between second differences and illumination intensities of the backlight, and store the mapping relationship in the driving device of the display panel.

The application further provides a display panel. The display panel includes two opposite display screens and a controller. Each display screen is connected with the controller, and the controller performs the following operations upon receiving image information to be displayed:

acquiring a liquid crystal response duration of each of the display screens;

taking a display screen having a shorter liquid crystal response duration as a first display screen, and taking a display screen having a longer liquid crystal response duration as a second display screen; and driving the second display screen to display, and delaying to drive the first display screen to display.

The display panel includes an upper display screen and a lower display screen, and light emitted by the backlight passes through the lower display screen and enters the upper display screen. It can be understood that the lower display screen acts as providing a dimming function, and the display panel can make the black images become blacker due to less light leakage, thereby improving the picture quality of the display panel.

Since the lower display screen acts only as providing a dimming function, a resolution of the lower display screen can be smaller than a resolution of the upper display screen. That is, the resolution of the upper display screen and the resolution of the lower display screen are different, and one pixel of the lower display screen corresponds to a plurality of pixels of the upper display screen. For example, one pixel of the lower display screen corresponds to four pixels of the upper display screen. Since the resolution of the upper display screen is greater than the resolution of the lower display screen, the processes of preparing the upper display screen and the lower display screen are different, thus a thickness of a thin film transistor (TFT) substrate and a color filter (CF) substrate of the upper display screen after being assembled together is different from a thickness of a TFT substrate and a CF substrate of the lower display screen after being assembled together. For the thicknesses are different, the response times of the liquid crystals of the two display screens are different, and the liquid crystals of the two display screens cannot rotate to the same positions at the same time, therefore the display brightness of the whole display panel is reduced, and the display effect of the display panel becomes poor. The response duration of the liquid crystals refers to the duration from a time point of a voltage being applied to the liquid crystal molecules to a time point of the liquid cry 1 molecules start to rotate.

The resolution of the upper display screen is higher than the resolution of the lower display screen. Therefore, compared with the TFT substrate of the lower display screen, there are more thin film transistors on the TFT substrate of the upper display screen, and the TFT substrate of the upper display screen has a heavier load, Therefore, after the TFT substrate and the CF substrate are assembled together, a thickness of the upper display screen is greater than a thickness of the lower display screen, that is, the liquid crystal response duration of the upper display screen is longer than the liquid crystal response duration of the lower display screen. In addition, since the lower display screen acts as providing a dimming function, a color filter film is not needed for the lower display screen, but a color filter film is needed to be provided on the TFT substrate of the upper display screen.

It can be understood that the resolution of the second display screen is higher than the resolution of the first display screen, and the thickness of the first display screen after the TFT substrate and the CF substrate are assembled together is smaller than that of the second display screen after the TFT substrate and the CF substrate are assembled together. A color filter film is disposed on the TFT substrate of the second display screen, and no color filter film is disposed on the TFT substrate of the first display screen.

In an embodiment, the display panel includes a driving board provided with the controller and data buffers corresponding to the display screens, and upon receiving the image information to be displayed, the driving board processes the image information, puts the processed display data into the data buffer of each display screen, and controls read/write clocks of the data buffers according to the liquid crystal response duration of each display screen, so as to drive the display screen with a relatively short liquid crystal response duration to delay to display.

The present application further provides a display device including the display panel according to the above embodiments.

The serial numbers of the embodiments of the present application are only for description, and do not represent the superiority or inferior of the embodiments.

It should be noted that the terms “comprising”, “including” or any other variation thereof herein are intended to cover a non-exclusive inclusion, such that a process, method, article, or system that includes a series of elements not only includes those elements, but also includes other elements not expressly listed, or an element inherent to such a process, method, article, or system. In the absence of more restrictions, an element defined by the phrase “comprising one . . . ” does not exclude the presence of additional identical elements in the process, method, article, or system that includes the element.

Through the description of the above embodiments, a person skilled in the art can clearly understand that the method described above can be implemented by means of software plus a necessary universal hardware platform, of course, can also be implemented by hardware, but in many cases, the former is preferred. Based on such an understanding, the technical solution of the present application essentially or the part giving a contribution to the prior art may be embodied in the form of a software product, and the computer software product is stored in a storage medium (such as a ROM/RAM, a magnetic disk, or an optical disk) as described above, and includes several instructions for enabling a terminal (which may be a mobile phone, a computer, a server, a television, or a network device, or the like) to execute the method according to various embodiments of the present application.

The above are only preferred embodiments of the present application, and are not therefore intended to limit the scope of the present application. Any equivalent structure or equivalent process transformation made using the description and drawings of the present application, or any direct or indirect application to other related technical fields, is included in the claimed scope of the present application.

What is claimed is:

1. A display method of a display panel, wherein the display panel comprises two display screens arranged opposite to each other, and the display method of the display panel comprises:

acquiring a liquid crystal response duration of each display screen upon receiving image information to be displayed;

taking a display screen having a shorter liquid crystal response duration as a first display screen, and taking a display screen having a longer liquid crystal response duration as a second display screen;

determining a first difference between the liquid crystal response duration of the first display screen and the liquid crystal response duration of the second display screen;

determining a duration of delaying to drive of the first display screen according to the first difference;

determining a target illumination intensity of a backlight according to the duration of delaying to drive;

controlling the backlight to emit light to each display screen according to the target illumination intensity, and executing the driving the second display screen to display; and driving the second display screen to display, and delaying to drive the first display screen to display, wherein the determining the target illumination intensity of the backlight according to the duration of delaying to drive comprises:

determining a preset illumination intensity as the target illumination intensity of the backlight, wherein the duration of delaying to drive is equal to the first difference.

2. The display method according to claim 1, wherein each display screen is provided with a data buffer, and each data buffer is configured for caching the image information to be displayed; and the driving the second display screen to display, and delaying to drive the first display screen to display comprises:

delaying input of the image information by controlling a read/write clock of a data buffer corresponding to the first display screen, to drive the first display screen to delay display relative to the second display screen.

3. A display panel, wherein the display panel comprises two display screens opposite to each other and a controller, each display screen is connected to the controller, and the controller is configured to perform following operations upon receiving image information to be displayed:

acquiring a liquid crystal response duration of each display screen;

taking a display screen having a shorter liquid crystal response duration as a first display screen, and taking a display screen having a longer liquid crystal response duration as a second display screen;

determining a first difference between the liquid crystal response duration of the first display screen and the liquid crystal response duration of the second display screen;

determining a duration of delaying to drive of the first display screen according to the first difference;

determining a target illumination intensity of a backlight according to the duration of delaying to drive;

controlling the backlight to emit light to each display screen according to the target illumination intensity, and executing the driving the second display screen to display; and driving the second display screen to display, and delaying to drive the first display screen to display, wherein the determining the target illumination intensity of the backlight according to the duration of delaying to drive comprises:

determining a preset illumination intensity as the target illumination intensity of the backlight, wherein the duration of delaying to drive is equal to the first difference.

4. The display panel according to claim 3, wherein a resolution of the second display screen is higher than a resolution of the first display screen, and a thickness of the first display screen after a thin film transistor substrate and a color filter substrate of the first display screen are assembled together is less than a thickness of the second display screen after a thin film transistor substrate and a color filter substrate of the second display screen are assembled together.

5. The display panel according to claim 3, wherein a thin film transistor substrate of the second display screen is provided with a color filter film, and a thin film transistor substrate of the first display screen is provided without a color filter film.

6. The display panel according to claim 3, wherein the display panel comprises a driving board provided with the controller and a data buffer corresponding to each display screen, and upon receiving the image information to be displayed, the driving board is configured to process the image information, store processed display data into the data buffer of each display screen, and control a read/write clock of each data buffer according to the liquid crystal response duration of each display screen, to drive the display screen having the shorter liquid crystal response duration to delay to display.

7. A display device comprising a display panel, wherein the display panel comprises two display screens opposite to each other and a controller, each display screen is connected to the controller, and the controller is configured to perform following operations upon receiving image information to be displayed:

acquiring a liquid crystal response duration of each display screen;

taking a display screen having a shorter liquid crystal response duration as a first display screen, and taking a display screen having a longer liquid crystal response duration as a second display screen;

determining a first difference between the liquid crystal response duration of the first display screen and the liquid crystal response duration of the second display screen;

determining a duration of delaying to drive of the first display screen according to the first difference;

determining a target illumination intensity of a backlight according to the duration of delaying to drive;

controlling the backlight to emit light to each display screen according to the target illumination intensity, and executing the driving the second display screen to display; and driving the second display screen to display, and delaying to drive the first display screen to display, wherein the determining the target illumination intensity of the backlight according to the duration of delaying to drive comprises:

determining a preset illumination intensity as the target illumination intensity of the backlight, wherein the duration of delaying to drive is equal to the first difference.

8. The display device according to claim 7, wherein each display screen is provided with a data buffer, and each data buffer is configured for caching the image information to be displayed; and the driving the second display screen to display, and delaying to drive the first display screen to display comprises:

delaying input of the image information by controlling a read/write clock of a data buffer corresponding to the first display screen, to drive the first display screen to delay display relative to the second display screen.

9. The display device according to claim 7, wherein a resolution of the second display screen is greater than a resolution of the first display screen, and a thickness of the first display screen after a thin film transistor substrate and a color filter substrate of the first display screen are assembled together is less than a thickness of the second display screen after a thin film transistor substrate and a color filter substrate of the second display screen are assembled together.

* * * * *